US006742353B2

(12) United States Patent
Ohashi et al.

(10) Patent No.: US 6,742,353 B2
(45) Date of Patent: Jun. 1, 2004

(54) REFRIGERATOR

(75) Inventors: Yoshiki Ohashi, Shiga (JP); Masatoshi Sasaki, Kyoto (JP); Yohei Nomoto, Shiga (JP); Hiroshi Yamada, Shiga (JP)

(73) Assignee: Matsushita Refrigeration Company, Shiga (JP)

( * ) Notice: Subject to any disclaimer, the term of this patent is extended or adjusted under 35 U.S.C. 154(b) by 0 days.

(21) Appl. No.: 10/276,929

(22) PCT Filed: Mar. 2, 2001

(86) PCT No.: PCT/JP01/01644

§ 371 (c)(1),
(2), (4) Date: Apr. 15, 2003

(87) PCT Pub. No.: WO01/90667

PCT Pub. Date: Nov. 29, 2001

(65) Prior Publication Data

US 2003/0167787 A1 Sep. 11, 2003

(30) Foreign Application Priority Data

May 22, 2000 (JP) ..... 2000-149398

(51) Int. Cl.[7] ..... F25D 11/02; F25D 17/08; F25D 17/04

(52) U.S. Cl. ..... 62/443; 62/407; 62/405

(58) Field of Search ..... 62/445, 407, 440, 62/441, 442, 408, 331, 405

(56) References Cited

U.S. PATENT DOCUMENTS

| | | | | |
|---|---|---|---|---|
| 2,712,733 A | * | 7/1955 | King | 62/405 |
| 3,364,694 A | * | 1/1968 | Cohen et al. | 62/265 |
| 3,572,049 A | * | 3/1971 | Moormans | 62/264 |
| 4,223,538 A | * | 9/1980 | Braden et al. | 62/443 |
| 5,388,427 A | * | 2/1995 | Lee | 62/331 |
| 5,406,805 A | * | 4/1995 | Radermacher et al. | 62/81 |

FOREIGN PATENT DOCUMENTS

| | | |
|---|---|---|
| JP | 54-145053 | 11/1979 |
| JP | 63-70071 | 3/1988 |
| JP | 07-091803 | 4/1995 |
| JP | 08-338681 | 12/1996 |
| JP | 10-292971 | 11/1998 |
| JP | 10-318653 | 12/1998 |
| JP | 11-044479 | 2/1999 |
| JP | 11-325695 | 11/1999 |
| JP | 2000-9372 | 1/2000 |

OTHER PUBLICATIONS

Japanese International Search Report for PCT/JP01/01644, dated May 15, 2001.

English translation of Japanese International Search Report for PCT/JP01/01644, dated May 15, 2001.

Japanese International Preliminary Examination Report for PCT/JP01/01644, dated Sep. 9, 2002.

*Primary Examiner*—William C. Doerrler
(74) *Attorney, Agent, or Firm*—RatnerPrestia

(57) ABSTRACT

A refrigerator is improved in storage environment by suppressing drying and oxidation and enhanced in volume efficiency and cooling efficiency. The refrigerator includes a refrigerating chamber, a vegetable chamber, and a freezing chamber in order from its top to its bottom. Cool air is introduced into the freezing chamber by a first cooler and a first fan, and is introduced into the refrigerating chamber by a second cooler and a second fan. These chambers function as a direct cooling chamber. The vegetable chamber functions as an indirect cooling chamber cooled by a cooling plate which is disposed at the top of the chamber and has a large thermal conductivity, which is cooled by forced convection by the second cooler and the second fan, producing the effects of low temperature radiation and natural convection in the chamber. This arrangement provides the refrigerator with quality maintaining effects in accordance with the suitability for storage of foods, and allows the refrigerator to assure high storing performance.

(List continued on next page.)

23 Claims, 12 Drawing Sheets

U.S. PATENT DOCUMENTS 5,465,591 A * 11/1995 Cur et al. ..... 62/439
5,491,980 A * 2/1996 Yingst et al. ..... 62/237
5,522,216 A * 6/1996 Park et al. ..... 62/3.6
5,551,252 A * 9/1996 Lee ..... 62/441
5,715,693 A * 2/1998 van der Walt et al. ..... 62/198
5,819,552 A * 10/1998 Lee ..... 62/407
6,550,268 B2 * 4/2003 Lee et al. ..... 62/407
2003/0010056 A1 * 1/2003 Sakamoto et al. ..... 62/441

* cited by examiner

REFRIGERATOR

THIS APPLICATION IS A U.S. NATIONAL PHASE APPLICATION OF PCT INTERNATIONAL APPLICATION PCT/JP01/01644.

TECHNICAL FIELD

The present invention relates to a refrigerator including three or more storage chambers arranged vertically.

BACKGROUND ART

A recent refrigerator is provided with storage chambers controlled at respective temperatures in accordance with kinds of foods stored therein. A conventional refrigerator mainly is provided with a freezing chamber at its top, a refrigerating chamber in its middle, and a vegetable chamber at its bottom. Recently, with priority given to being easy to use, a refrigerator provided with a refrigerating chamber at the top, and a freezing chamber and a vegetable chamber at the middle and center have been proposed and widely used. And, due to a recent health boom, a refrigerator is provided with a vegetable chamber in the middle for conveniently handling vegetables best.

A conventional refrigerator with a vegetable chamber arranged in its middle is disclosed in Japanese Patent Laid-open No.8-338681.

FIG. 12 is a sectional view of the conventional refrigerator. Refrigerator body 1 is vertically partitioned by insulating partition wall 2, and is provided with refrigerating chamber 3 and vegetable chamber 4 for storing vegetables and fruits at the top, and freezing chambers 5 and 6 at the bottom. Hinged door 7 is disposed at the front opening portion of the refrigerating chamber 3. Drawer door 8 is fitted to the front opening portion of the vegetable chamber. Drawer doors 9 and 10 fits to respective opening portions of the freezing chambers 5 and 6. Storage container 11 is drawn out along with the drawer door of the vegetable chamber, and upper storage container 12 is disposed at the top rear of the storage container 11. Storage containers 13 and 14 are drawn out along with the drawer door of the refrigerating chamber. In the vegetable chamber 4 closed with the drawer door 8, lid 16 provided with wet member 15 covers the upper opening portion of the storage containers 11 and 12 to keep them nearly closed and forms cool air convection passage 17 at the outer periphery of the storage containers 11, 12 and lid 16. At the lowest stage of door pocket 18 at the interior side of the hinged door 7 of the refrigerating chamber, bottle rack 19 is provided for storing PET bottles or cartons of milk. Low temperature chamber 20 is disposed at the bottom of the refrigerating chamber 3, where meat and fish are stored at a temperature lower than that of the refrigerating chamber. Fan 22 for forced draft is provided at the back of the vegetable chamber 4, that is, above cooler 21 for freezing cycle. Air passage control panel 23 disposed at the back of the vegetable chamber 4 and low temperature chamber 20 is provided internally with damper 24 for adjusting the amount of the cool air supplied to the refrigerating chamber 3, vegetable chamber 4, and low temperature chamber 20. The cooler 21 and the fan 22 are vertically arranged above compressor 25 disposed at the outside bottom rear of the refrigerator main body 1. Height h from a floor, where the refrigerator main body 1 is installed, to the upper end of the drawer door 8 of the vegetable chamber satisfies 850 mm≦h≦1000 mm.

In this refrigerator, the air cooled by the cooler 21 is directly introduced by the fan 22 into the refrigerating chambers 5 and 6, and directly introduced into the refrigerating chamber 3, vegetable chamber 4, and low temperature chamber 20 via a cool-air-amount-adjusting operation of the damper 24. Accordingly, the air cooled by the cooler 21 is forced under convection in each chamber, and is then directly cooling and maintaining the inside of each chamber at a predetermined temperature. The cool air is forced under convection in the interior of the vegetable chamber 4 as well, but the air circulates in the convection passage 17 and indirectly cools the contents of the container from the outer periphery of the storage containers 11, 12, and the lid 16.

Since the height h satisfies 850 mm≦h≦1000 mm, a user can smoothly move the food without raising his/her elbow within a height of a table (850 mm) of a sink often adjoining the refrigerator main body 1 to the standard height 970 mm of the elbow of the user.

In the conventional refrigerator described above, since the air cooled by the cooler 21 is forced under convection in each refrigerating chamber by a circulating operation of the fan 22, the refrigerator is not suitable for storing foods, such as vegetables and fruits, meat, and fish, to be prevented from promotion of drying or oxidation when directly exposed to the cool air.

The contents of the vegetable chamber 4 are indirectly cooled without introducing the cool air directly into the storage containers 11 and 12. But the convection passage 17 formed at the periphery of the storage containers 11, 12, and the lid 16 is necessary to have a capacity enough to assure a specified cooling power, thus causing the substantial storing capacity of the refrigerator to be reduced much. Further, the total distance of the air circulating passage of the fan 22 becomes longer, thus requiring a larger-sized fan. This increases a power consumption and noise, and making its cooling power for the vegetable chamber 4, which is cooled at last, be insufficient due to a large passage resistance and passage heat absorption.

Since the cooler 21 and the fan 22 are arranged above the compressor 25, the vegetable chamber 4 is shortened, and sizes of the storage containers 11 and 12 are restricted. This arrangement makes the capacity insufficient for storing vegetables and fruits, which are recently consumed more.

Further, the position at which the stored bottles are held in the bottle rack 19 is about 150 mm high from the lower end of the hinged door 7. And the lower end of the door 7 is about 15 mm high from the upper end of the drawer door 8 of the vegetable chamber. Since the height h from the floor to the upper end of the door 8 satisfies 850 mm≦h≦1000 mm, the user reaches the bottles at a height of about h+165 mm, that is, 1015 mm≦(h+165 mm)≦1165 mm. Accordingly, the position at which heavy PET bottles or cartons of milk are handled is higher than 970 mm, the height of the elbow of the user, and this causes a burden on the user.

SUMMARY OF THE INVENTION

A refrigerator is enhanced in volume efficiency and cooling efficiency, and provides storing environment for suppressing drying and oxidation of foods stored therein. The refrigerator assures a sufficient storing capacity of a vegetable chamber since its length is not restricted. Further, the refrigerator is improved in easy-to-use of, particularly, a bottle rack at a door pocket of a refrigerating chamber.

The refrigerator is internally partitioned to have three or more storage chambers vertically arranged. At least one of the storage chambers is an indirect cooling chamber having an exterior cooled without introducing cool air into the chamber, and other chambers are direct cooling chambers into which the cool air is introduced for cooling. Due to this multiple chamber configuration in a vertical direction, an installation space for the refrigerator is reduced. The refrigerator is under divisional storage control properly executed since foods to be prevented from drying and oxidation are stored in the indirect cooling chamber, while foods to be rapidly cooled are stored in the direct cooling chamber.

DETAILED DESCRIPTION OF PREFERRED EMBODIMENTS (Exemplary Embodiment 1)

Figure 1:
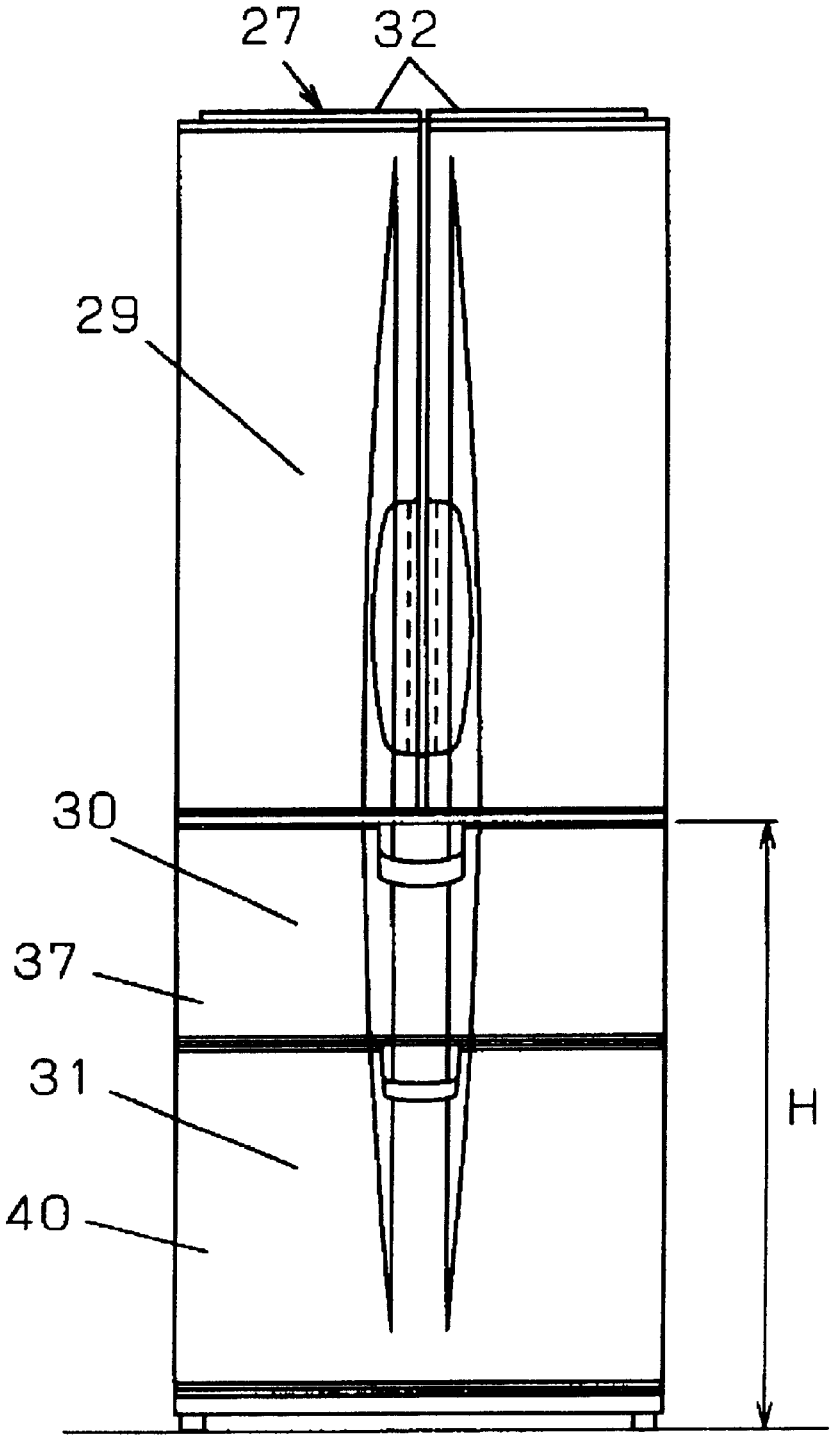
FIG. 1 is an outside front view of a refrigerator according to exemplary embodiment 1 of the present invention.
Figure 2:
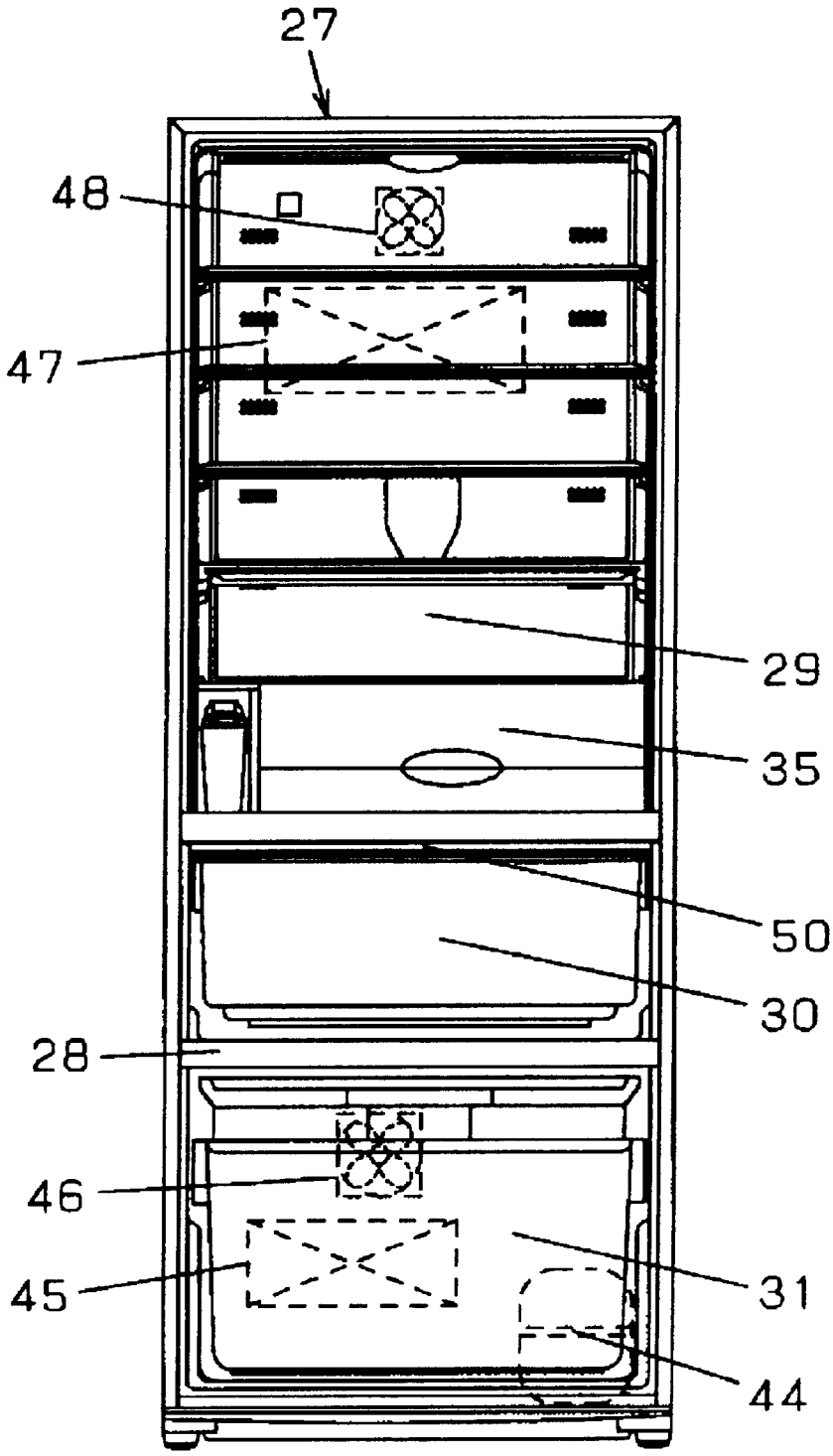
FIG. 2 is an interior front view of the refrigerator according to embodiment 1.
Figure 3:
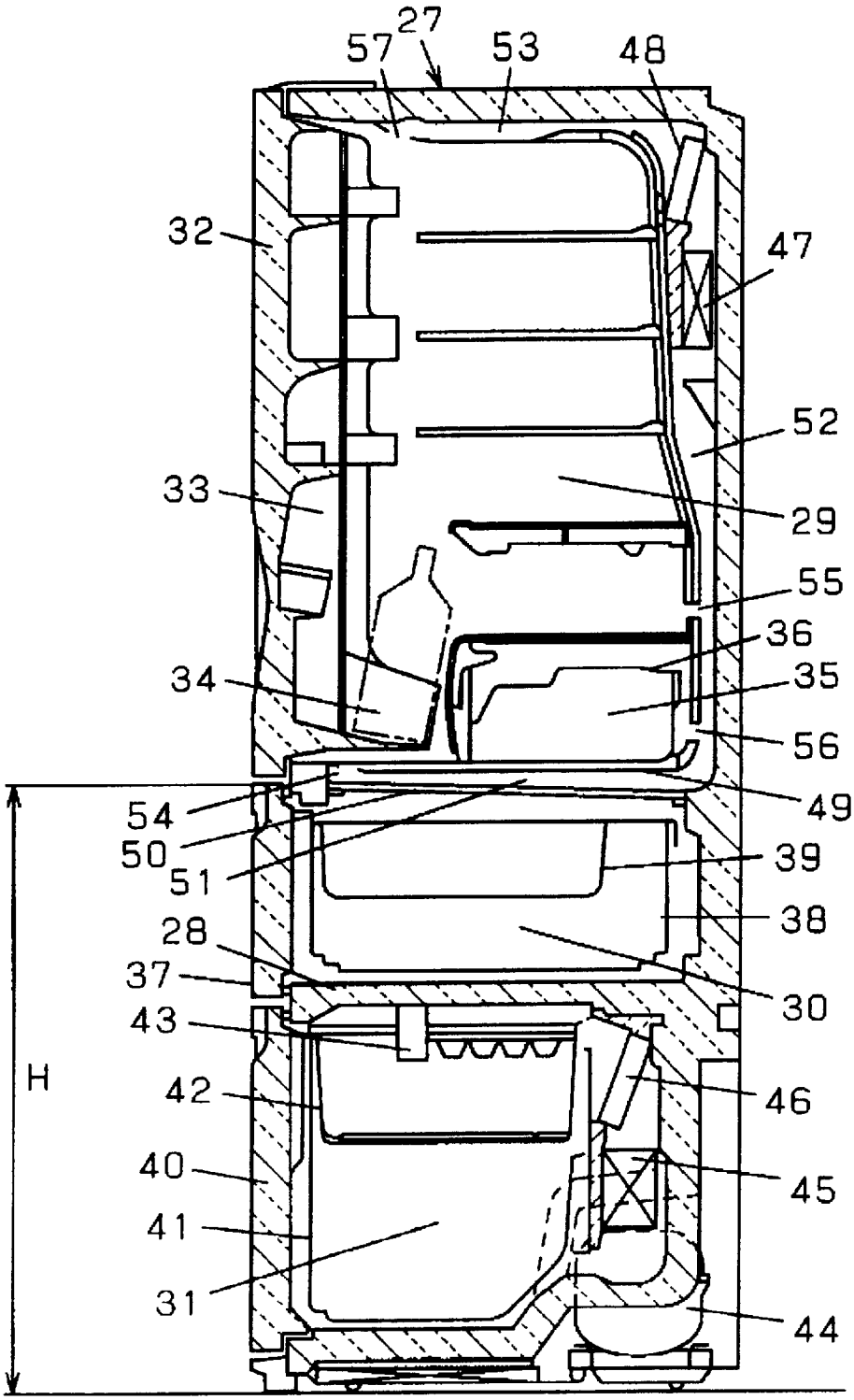
FIG. 3 is a sectional view of the refrigerator according to embodiment 1.

FIG. 1 is an outside front view of a refrigerator according to exemplary embodiment 1 of the present invention. FIG. 2 is an interior front view of the refrigerator. FIG. 3 is a sectional view of the refrigerator. Heat insulating partition wall 28 internally partitions refrigerator main body 27 into its upper and lower sections, thus forming refrigerating chamber 29 at its top, vegetable chamber 30 thereunder, and freezing chamber 31 at its bottom. Double door 32 is fitted to the right and left of the opening portion of the refrigerating chamber 29, and at the interior side thereof is provided with door pocket 33. Bottle rack 34 disposed at the lowest portion of the door pocket 33 is used for storing PET bottles and cartons of milk which are relatively large and heavy. Low temperature chamber 35 disposed at the inside bottom of the refrigerating chamber 29 is provided with storage container 36 for mainly string perishable foods, such as meat and fish, at temperatures lower than that of the refrigerating chamber (for example, chilled at about 0° C., partial freezing at about −3° C., and so on). Drawer door 37 fitted to the opening portion of the vegetable chamber 30 can be drawn out along with storage container 38 at its interior side. Upper storage container 39 is detachably disposed at the upper portion of the storage container 38. Also, drawer door 40 fitted to the opening portion of the freezing chamber 31 can be drawn out along with storage container 41 at its interior side. Upper storage container 42 is disposed at the upper portion of the storage container 41 which is movable in forward and backward directions. Ice maker 43 is disposed at the ceiling portion inside the freezing chamber 31. Compressor 44 for freezing cycle is installed at the bottom rear of the refrigerator main body 27. First cooler 45 is arranged side by side with the compressor 44 via the heat insulating wall of the refrigerator main body 27, and is accommodated at the inside rear of the freezing chamber 31. First fan 46 for forced draft is disposed above and close to the first cooler 45. Both the first cooler 45 and the first fan 46 are accommodated at the rear of the freezing chamber 31, not pervading the rear region of the vegetable chamber 30. Second cooler 47 is arranged at the upper inside rear of the refrigerating chamber 27. Second fan 48 is disposed above and close to the second cooler 47. Partition plate 49 is disposed between the refrigerating chamber 29 and the vegetable chamber 30, forming the bottom of the refrigerating chamber 29. Cooling plate 50 closes the top opening of the vegetable chamber 30 at a specified interval under the partition plate 49, and forms a part of an outer envelop of the vegetable chamber 30. The cooling plate 50 is made of metal, such as aluminum or material having a large thermal conductivity. The partition plate 49 and the cooling plate 50 form draft passage 51 between them. Intake air passage 52 is disposed at the back of the refrigerating chamber 29, and allows air after cooling in the refrigerating chamber 29 to be taken into the second cooler 47. Discharge air passage 53 is disposed at the inside top of the refrigerating chamber 29, and allows air cooled by the second cooler 47 to be discharged by the second fan 48 into the refrigerating chamber 29. The draft passage 51, the intake air passage 52, and the discharge air passage 53 are connected in series, which are arranged so as to surround the three sides except the internal door side of the refrigerating chamber 29. The draft passage 51 is provided with intake port 54 at its front. The intake air passage 52 is provided with intake ports 55 and 56 for taking air which has cooled the refrigerating chamber 29 and the low temperature chamber 35. Discharge port 57 is provided at the front of discharge air passage 53 for discharging the cool air into the refrigerating chamber 29.

In the above configuration, the cooled air is directly introduced into the freezing chamber 31 by the first cooler 45 and the first fan 46, and into the refrigerating chamber 29 by the second cooler 47 and the second fan 48. That is, the refrigerating chamber 29 and the freezing chamber 31 function as direct cooling chambers. The cool air is not introduced into the vegetable chamber 30 which functions as an indirect cooling chamber cooled via the cooling plate 50.

Height H from a floor where the refrigerator main body 27 is installed to the upper end of the drawer door 37 of the vegetable chamber satisfies 600 mm$\leqq$H$\leqq$850 mm.

An operation of the above refrigerator will be described.

The refrigerating chamber 29, freezing chamber 31, and low temperature chamber 35 function as direct cooling chambers in which their contents are cooled by forced convection of the cool air directly introduced into their interiors. The air cooled by the first cooler 45 is directly introduced by the first fan 46 into the freezing chamber 31, and the contents of the storage container 41 and the upper storage container 42 are directly cooled by forced convection and stored at freezing temperatures. The air cooled by the second cooler 47 is forcibly circulated by the second fan 48 and directly discharged from the discharge port 57 into the refrigerating chamber 29 via the discharge air passage 53. Simultaneously, the cool air is directly discharged from a discharge port (not shown) into the low temperature chamber 35. The cooled air used to directly cool the contents of the refrigerating chamber 29 by forced convection is collected into the intake air passage 52 from the intake port 55 and returns to the second cooler 47. At this moment, a part of the cool air discharged into the refrigerating chamber 29 is introduced from the intake port 54 at the bottom of the chamber 29 into the draft passage 51 and returns to the second cooler 47 through the intake air passage 52 while cooling the cooling plate 50. The cool air directly introduced into the low temperature chamber 35 similarly returns from the intake port 56 to the second cooler 47 through the intake air passage 52 after cooling the contents. Accordingly, the contents stored in these chambers are rapidly cooled since they are placed under cooling environment having a relatively large heat transfer coefficient. Thus, the refrigerating chamber 29, freezing chamber 31, and low temperature chamber 35 are suitable for cooling storage of general foods, such as daily dishes, processed foods, frozen foods, and drinks, to desirably be cooled down to specified storage temperatures in a short time when they are stored for the first time or when the temperature is raised due to opening and closing of the refrigerator door.

The cooling plate 50 cooled by forced convection of cool air passing through the draft passage 51 is made of material having a large thermal conductivity, such as an aluminum plate, and the plate 50 is therefore quickly and nearly uniformly cooled over the entire surface to be lowered in temperature. As a result, the cooling plate 50 functions as an indirect cooling plate for the vegetable chamber 30 and is disposed at the top of the chamber 30. That is, the cooling plate 50 cools the contents stored in the storage container 38 and upper storage container 39 of the vegetable chamber 30 by radiant cooling with a temperature difference and a downward cooling caused by natural convection, thereby allowing the vegetable chamber 30 to function as an indirect cooling chamber.

Accordingly, in the vegetable chamber 30, the contents are placed under cooling environment having a relatively small heat transfer coefficient, thus being prevented from drying. Therefore, the vegetable chamber is suitable for cooling storage of perishable foods, such as vegetables and fruits, which has storage quality affected by transpiration of water in particular.

Since the vegetable chamber 30 is closed with the cooling plate 50 at its top and is not directly communicated with other cooling chambers, water slowly transpired from stored vegetables and fruits is utilized to increase an interior humidity in the chamber 30, thereby keeping the interior of the vegetable chamber 30 at high humidity. This with the drying preventing effect due to indirect cooling further suppresses the reduction of water by the synergistic effect. Therefore, the refrigerator provides storage control for maintaining quality of the foods for a long time.

As described above, the refrigerator is partitioned into three or more sections of storage chambers including the direct cooling chambers kept at freezing and refrigerating temperatures, and the indirect cooling chambers kept at refrigerating temperatures. This arrangement provides the refrigerator with a high storage efficiency, while suppressing the lowering of food quality under the storage control according to suitability for the stored foods.

The vegetable chamber 30 in the middle of the refrigerator main body is cooled by a part of the circulating cooling air passage of the refrigerating chamber 29 adjoining its top, thus allowing the refrigerator to have a simple structure. Since the total distance of the circulating air passage is not particularly elongated, the draft resistance does not increase while the cooling efficiency increases. This allows an indirect cooling chamber to be economically and rationally obtained.

The cooling temperature of the vegetable chamber 30 may be generally about 5° C. that is equivalent to or a little higher than that of the refrigerating chamber 29. The temperature provides the refigerater with efficient cooling by the second cooler 47 for refrigerating chambers kept at relatively high temperatures. Further, a indirect cooling surface of the cooling plate 50 is not excessively cooled, and the water transpired from the stored foods does not form dew or freeze.

If the cooling temperature of the vegetable chamber 30 is necessarily lowered in order to improve the storage quality, the cooling plate 50 preferably has a larger surface area or extend its installation other than at the top of the chamber 30. Or, the draft passage 51 for cooling the cooling plate 50 is connected not to the intake air passage 52 of the refrigerating chamber but partially directly connected to the end of the discharge air passage 53, thereby allowing the cool air to pass forward from the bottom rear of the refrigerating chamber. As above, the cooling plate 50 is cooled preferably by the cool air that is discharged at low temperatures and has high cooling power.

The vegetable chamber 30 does not internally require a convection passage of cool air for cooling over the entire periphery of the storage container 38, the passage being required in a conventional refrigerator. Accordingly, the storage container 38 can be enlarged up to a size which does not affect the opening and closing of the drawer door 37, thereby increasing the storing capacity.

The refrigerator main body 27 has the refrigerating chamber 29, vegetable chamber 30, and freezing chamber 31 vertically arranged from top to bottom in the order of higher using frequency. This arrangement provides the refrigerator with multiple section control in a relatively small installation space without affecting its convenience. The vegetable chamber 30 in the middle particularly has a storing capacity as an indirect cooling chamber. This allows the user to open the drawer door 37 and to handle the contents while taking an extensive view of the whole from above in a standing posture without stooping.

The freezing chamber 31 at the bottom being rather poor in convenience is also provided with the drawer door 40, thereby reducing difficulty of handling the contents. Also, since the refrigerating chamber 29, which is most frequently used and has the largest storing capacity, has a hinged door, the user can handle the contents while taking an extensive view of them in front of him/her at the height of his/her eyes. In particular, the double door 32 separately opens to the right and left, and does not occupy a large space when opening and closing. The door 32 and the drawer doors 37 and 40 for the vegetable chamber 30 and the freezing chamber 31 provide a refrigerator with convenience.

Further, when handling PET bottles or cartons of milk in the refrigerating chamber 29, the user opens the door 32 of the refrigerating chamber and reaches the bottle rack 34 at the lowest portion of the door pocket 33. Then, the height H from the floor to the upper end of the door 37 of the vegetable chamber allows the height of the portion where the bottles in the bottle rack 34 to be held at nearly H+150 mm. If (H+150 mm)<1000 mm, the height is within a range of the height of the user's standard elbow, i.e., 970 mm plus the height of his/her footwear. This arrangement allows the user to handle heavy bottles in the bottle rack 34 without raising his/her elbow.

That is, since H<850 mm, it is not burdensome but very easy for the user to take the bottles which are rather frequently used everyday. The height allows even little children, who often use the bottles, to take the bottles conveniently and safely.

Also, the lowest portion that can be easily reached by a user of 155 cm in height standing 400 mm away from the refrigerator is located at 630 mm. Accordingly, in case of H≧600 mm, the height of the lowest storing surface in the refrigerating chamber 29 is nearly H+50 mm≧650 mm. This arrangement allows the user to easily take the foods in and out of the refrigerating chamber 29 in a standing posture.

Accordingly, if the upper end height H of the drawer door 37 of the vegetable chamber satisfies 600 mm≦H<850 mm for the layout of each storage chamber, the height provides an easy-to-use refrigerator including the refrigerating chamber 29 used frequently.

The first cooler 45, being arranged side by side with the compressor 44, can be arranged lower. This arrangement allows the first cooler 45 or the first fan 46 above it to be installed at the back of the freezing chamber 31 and prevents them from invading the back area of the vegetable chamber 30. In the vegetable chamber having an increased storing capacity as an indirect cooling chamber, the length of the storage container 38 can be elongated up to near the back insulating material, and thereby, the storing capacity further increases.

(Exemplary Embodiment 2)

Figure 4:
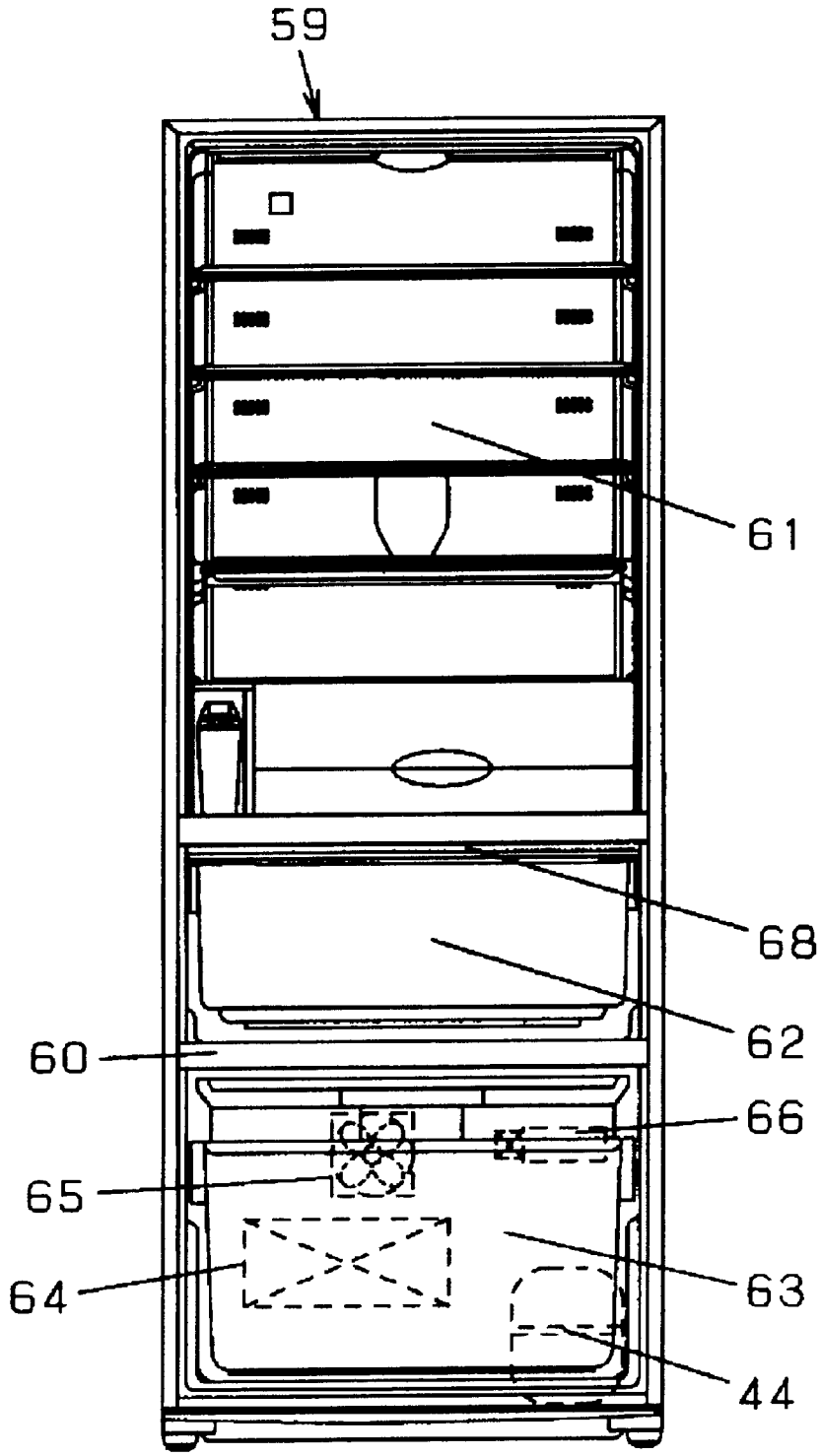
FIG. 4 is an interior front view of a refrigerator according to exemplary embodiment 2 of the invention.
Figure 5:
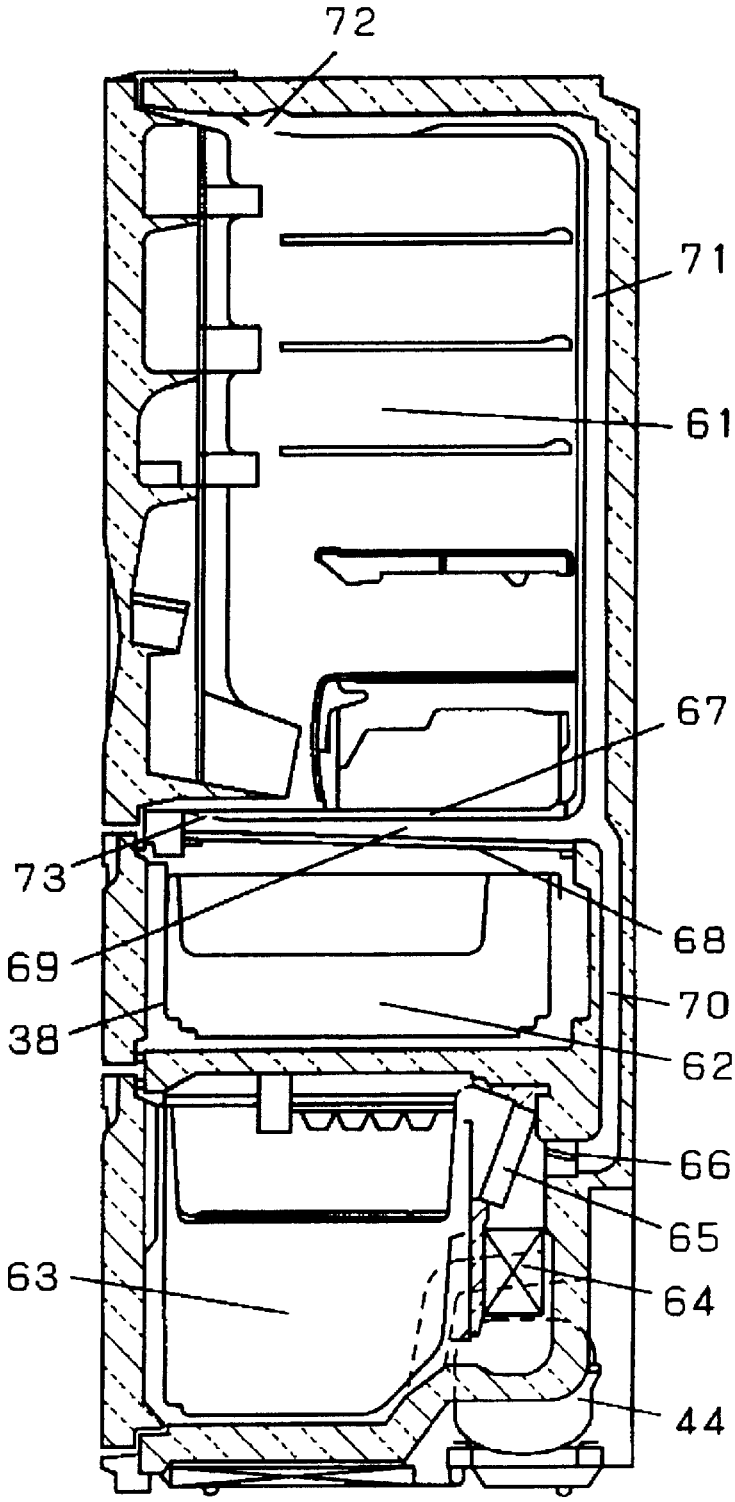
FIG. 5 is a sectional view of the refrigerator according to embodiment 2.

FIG. 4 is a front view of an interior of a refrigerator in exemplary embodiment 2 of the present invention. FIG. 5 is a sectional view of the refrigerator. Insulating partition wall 60 partitions refrigerator main body 59 into upper and lower sections to form refrigerating chamber 61 at its top, vegetable chamber 62 thereunder, and freezing chamber 63 at the bottom. Cooler 64 is arranged side by side with compressor 44 at the back of the freezing chamber 63. Fan 65 for forced draft is disposed above and close to the cooler 64. Damper unit 66 for cool air adjustment is arranged side by side with the fan 65. Cooler 64, fan 65, and damper unit 66 are disposed at the back of the freezing chamber 63 and do not intrude on the rear area of the vegetable chamber 62. Partition plate 67 is disposed between the refrigerating chamber 61 and the vegetable chamber 62. Cooling plate 68 closes the top opening of the vegetable chamber 62 at a specified interval under the partition plate 67. The cooling plate 68 is made of material having a large thermal conductivity to form a part of an outer envelop of the vegetable chamber 62. Draft passage 69 is formed between the partition plate 67 and the cooling plate 68. The fan 65 circulates the air cooled by the cooler 64 through the draft passage 70 and the damper unit 66. Discharge air passage 71 is disposed from the back to the top of the refrigerating chamber 61, and directly discharges the cool air into the refrigerating chamber 61. Discharge port 72 is provided at the front top of the discharge air passage 71. Vent hole 73 is provided at the front of the draft passage 69. The draft passage 70 is connected to the discharge air passage 71 at the bottom rear of the refrigerating chamber 61 and is connected to the draft passage 69.

An operation of the refrigerator having the above configuration will be described.

The air cooled by the cooler 64 is directly introduced by the fan 65 into the freezing chamber 63 in which the contents directly cooled by forced convection are stored at freezing temperatures. Next, the amount of the cool air forcibly circulated by the fan 65 is adjusted by the damper unit 66, and the cool air is directly discharged from the discharge port 72 into the refrigerating chamber 61 through the draft passage 70 and the discharge air passage 71. That is, the refrigerating chamber 61 and the freezing chamber 63 function as direct cooling chambers in which the contents are cooled by forced convection of the cool air directly introduced into their interiors. Accordingly, the contents are rapidly cooled since being placed under a cooling environment having a relatively large heat transfer coefficient. The refrigerating chamber 61 is suitable for cool-storing general foods, such as daily dishes, processed foods, frozen foods, and drinks, which is preferably cooled down to specified storage temperatures in a short time when they are stored for the first time or when the temperature is raised due to opening and closing of the door.

The cool air flowing in the draft passage 70 also flows in the draft passage 69, for nearly-uniformly cooling the cooling plate 68 having a large thermal conductivity. The cooling plate 68 functions as an indirect cooling plate for the vegetable chamber 62 and disposed at the top of the chamber 62. That is, the cooling plate 68 indirectly cools the contents by radiant cooling due to a temperature difference and downward cooling by natural convection.

Accordingly, in the vegetable chamber 62, the contents are placed under a cooling environment having a relatively small heat transfer coefficient, thus causing their drying to be suppressed. Therefore, the vegetable chamber is suitable for cool-storing perishable foods, such as vegetables and fruits, of which storage quality is closely related to transpiration of water in particular.

As described above, the refrigerator is partitioned into three or more sections of storage chambers, direct cooling chambers kept at freezing and refrigerating temperatures, and indirect cooling chambers kept at refrigerating temperatures. Cooler 64 and fan 65 for cooling these storage chambers provides the chambers with storage control in accordance with the suitability for storage of the foods stored in the refrigerator and to enhance the storage capacity.

Similarly to embodiment 1, the vegetable chamber 62 is not necessary to be internally provided with a convection passage of cooled air for cooling over the entire periphery of the storage container 38, which are provided in a conventional refrigerator. Therefore, the storage container 38 can be enlarged up to the extent that no hindrance is caused due to opening and closing of the drawer door 37, thereby increasing the storing capacity.

Further, similarly to embodiment 1, the cooler 64 is arranged side by side with the compressor 44. This arrangement allows the refrigerator to be lower. As a result, the cooler 64, the fan 65, and the damper unit 66 which are disposed there above may be installed at the back of the freezing chamber 63 and do not intrude on the rear of the vegetable chamber 62. The length of the storage container 38 can be elongated up to near the back insulating material, and this arrangement increases the storing capacity.

(Exemplary Embodiment 3)

Figure 6:
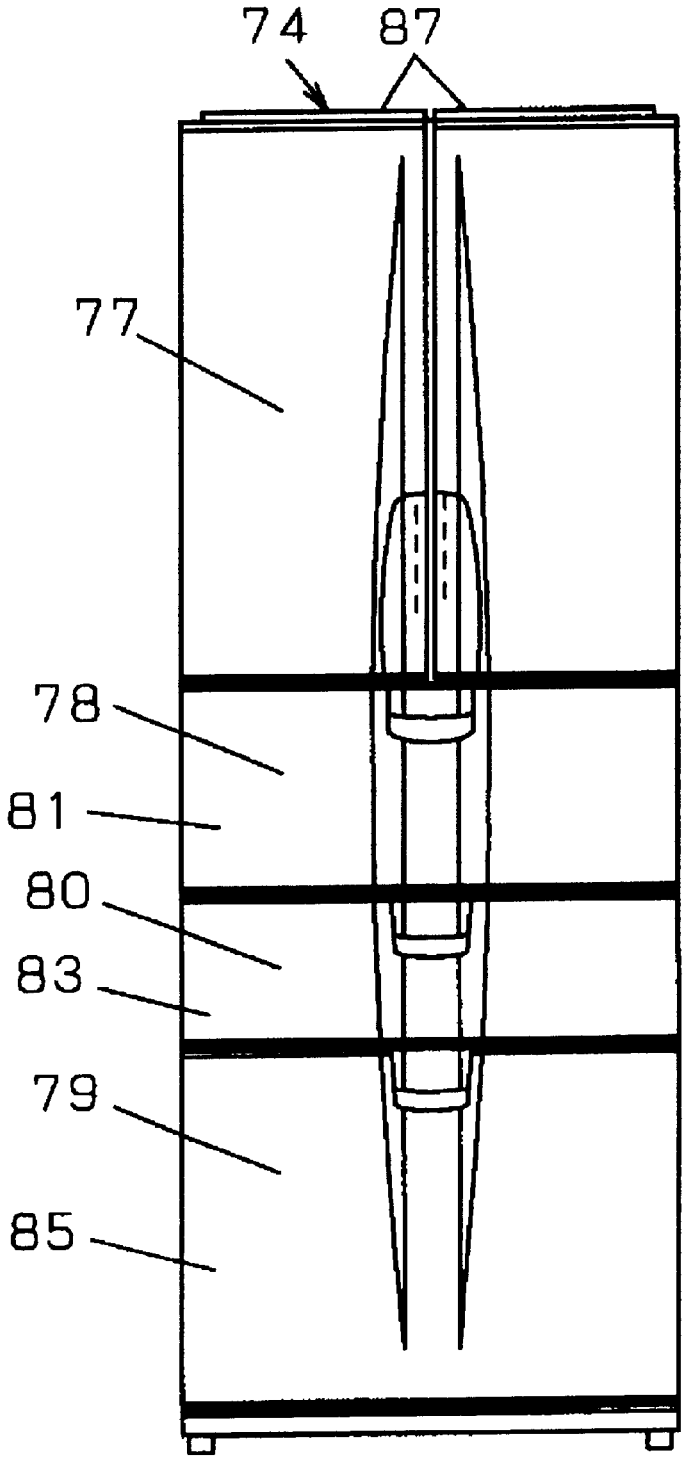
FIG. 6 is an outside front view of a refrigerator according to exemplary embodiment 3 of the invention.
Figure 7:
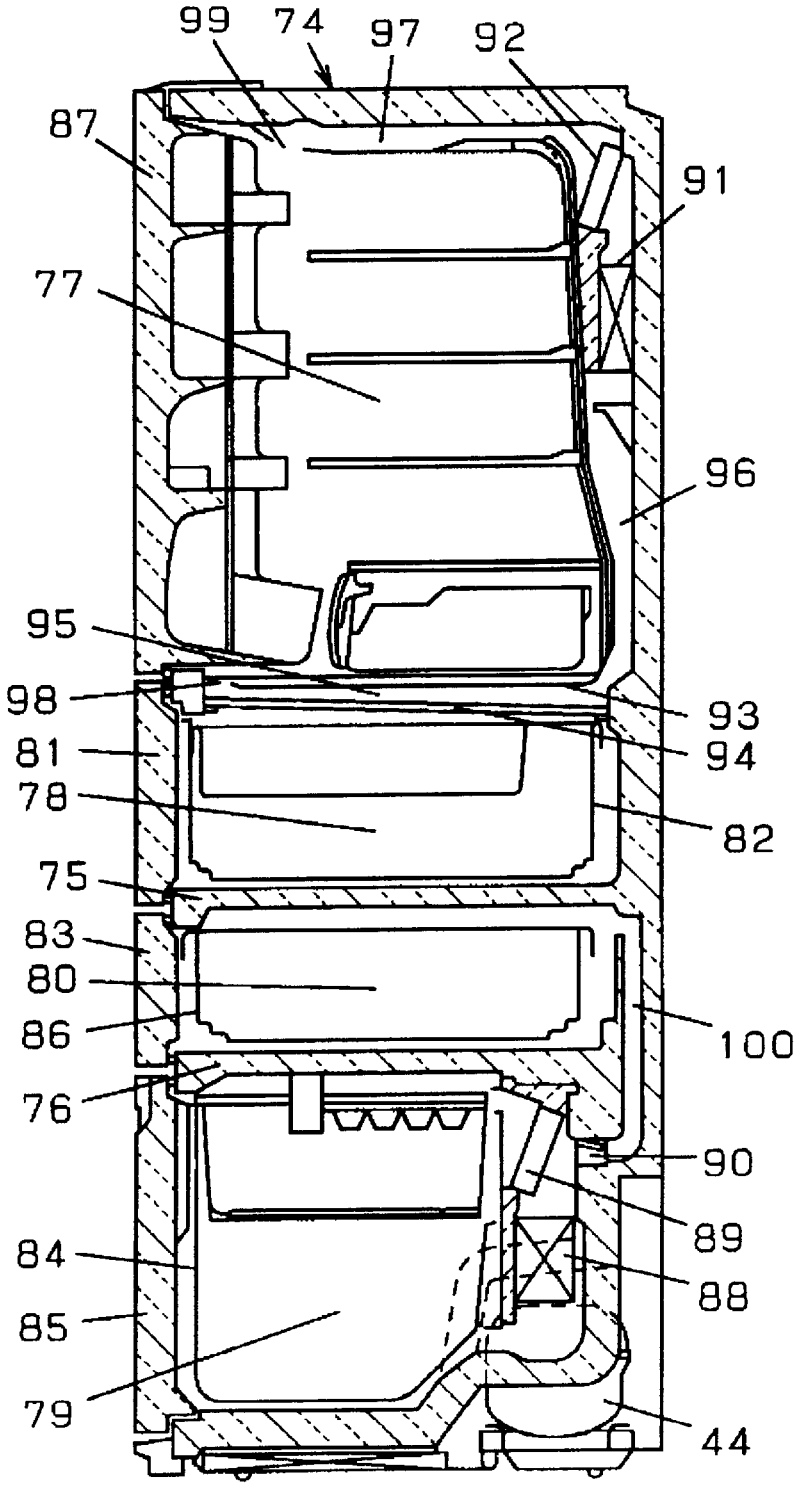
FIG. 7 is a sectional view of the refrigerator according to embodiment 3.

FIG. 6 is an outside front view of a refrigerator according to exemplary embodiment 3 of the present invention. FIG. 7 is a sectional view of the refrigerator. Insulating partition walls 75 and 76 partition refrigerator main body 74 into upper and lower sections. The insulating partition wall 75 forms refrigerating chamber 77 at the top and vegetable chamber 78 thereunder. Under the insulating partition wall 76, freezing chamber 79 is formed. Multi-purpose chamber 80 is formed between the insulating partition walls 75 and 76. Drawer door 81 is fitted to the opening of the vegetable chamber 78 and is drawn out along with storage container 82 at the interior side. Drawer door 83 is fitted to the opening of the freezing chamber 79 and is drawn out along with storage container 84. Drawer door 85 is fitted to the opening the multi-purpose chamber 80 and is drawn out along with storage container 86. Double door 87 is fitted to the opening of the refrigerating chamber 77. First cooler 88 is arranged side by side with the compressor 44 at the back of the freezing chamber 79. First fan 89 for forced circulation is installed above and close to the cooler 88. Damper unit 90 for cool-air-amount adjustment is arranged side by side with the fan 89. The first cooler 88, first fan 89, and damper unit 90 are disposed at the back of the freezing chamber 79 and do not intrude on the rear of the vegetable chamber 78. Second cooler 91 is arranged at the rear top inside the refrigerating chamber 77. The second fan 92 for forced circulation is disposed above and close to the second cooler 91. Partition plate 93 is disposed between the refrigerating chamber 77 and the vegetable chamber 78. Cooling plate 94 closes the top opening of the vegetable chamber 78 at a specified interval under the partition plate 93. The cooling plate 94 made of material having high thermal conductivity form a part of the outer envelop of the vegetable chamber 78. Draft passage 95 is formed between the partition plate 93 and the cooling plate 94. Intake air passage 96 is disposed at the back of the refrigerating chamber 77 and takes the air after cooling in the refrigerating chamber 77 into the cooler 91. Discharge air passage 91 is disposed at the top portion in the refrigerating chamber 77, through which the air cooled in the cooler 91 is discharged by the fan 92 into the refrigerating chamber 77.

The draft passage 95, intake air passage 96, and discharge air passage 97 are connected to each other and arranged so as to surround the three sides except the interior door side of the refrigerating chamber 77. Intake port 98 is provided at the front of the draft passage 95. Discharge port 99 is provided at the front of the discharge air passage 97 and discharges the cool air into the refrigerating chamber 77. The air cooled by the cooler 88 is delivered by the fan 89 into the multi-purpose chamber 80 through draft passage 100 and damper unit 90.

Accordingly, each of the freezing chamber 79 functions as a direct cooling chamber with the first cooler 88 and the first fan 89. The refrigerating chamber 77 functions as a direct cooling chamber with the second cooler 91 and the second fan 92. The multi-purpose chamber 80 functions as a direct cooling chamber with the first cooler 88, the first fan 89 and the damper unit 90. The direct cooling chambers directly introduces the cool air into the interior. The cool air is not introduced into the interior of the vegetable chamber 78 which functions as an indirect cooling chamber via the cooling plate 94.

An operation of the refrigerator having the above configuration will be described.

The air cooled by the first cooler 88 is directly introduced by the first fan 89 into the freezing chamber 79 in which the contents are directly cooled by forced convection and are stored at freezing temperatures. A part of the cooled air is adjusted by the damper unit 90 to an appropriate amount and is directly introduced into the multi-purpose chamber 80 through the draft passage 100 in order to directly cool the contents by forced convection. The contents are stored at desired temperatures ranging from a refrigerating temperature to a freezing temperature by the adjustment made by the user.

The air cooled by the second cooler 91 is forced and directly discharged by the second fan 92 into the refrigerating chamber 77 from the discharge port 99 through the discharge air passage 97. A part of the cooled air for cooling the contents of the refrigerating chamber 77 directly by forced convection is guided into the draft passage 95 from the intake port 98 at the bottom and returns to the second cooler 91 through the intake air passage 96 after cooling the cooling plate 94. That is, the refrigerating chamber 77, freezing chamber 79, and multi-purpose chamber 80 function as a direct cooling chamber in which the contents are cooled by forced convection of the cooled air directly introduced into the interior. Accordingly, the contents are rapidly cooled since being placed under a cooling environment having a relatively large heat transfer coefficient. The refrigerating chamber 77 is suitable for cool-storing general foods, such as daily dishes, processed foods, frozen foods, and drinks, which are preferably cooled down to specified storage temperatures in a short time when they are stored for the first time or when the temperature is raised due to opening and closing of the door.

The cool air flowing in the draft passage 95 quickly cools the entire surface of the cooling plate 94 nearly uniformly to lower the temperature. The cooling plate 94 functions as an indirect cooling plate for cooling the vegetable chamber 78 and disposed at the top thereof. That is, the cooling plate 94 indirectly cools the contents of storage container 82 by radiant cooling with a temperature difference and of downward cooling caused due to natural convection.

Accordingly, in the vegetable chamber 78, the contents are placed under a cooling environment having a relatively small heat transfer coefficient, thus suppressing their drying. Therefore, the vegetable chamber is suitable for cool-storing perishable foods, such as vegetables and fruits of which storage quality is closely related with transpiration of water in particular.

As described above, the refrigerator is partitioned into three or more sections of storage chambers, direct cooling chambers kept at freezing and refrigerating temperatures having a function of being able to select proper temperatures, and indirect cooling chambers kept at refrigerating temperatures. The stored foods are cooled in the chambers according to their suitability for storage. This suppresses the reduction of food quality, and provides a refrigerator that assures excellent storage performance.

The vegetable chamber 78 is not necessary to be internally provided with a convection passage of cool air for cooling over the entire periphery of the storage container 82, which is provided in a conventional refrigerator. Accordingly, the storage container 82 can be enlarged up to the extent that no hindrance is caused due to opening and closing of the drawer door 81, thereby increasing the storing capacity.

The refrigerating chamber 77 provided with the double door 87. The vegetable chamber 78, multi-purpose chamber 80, and freezing chamber 79 provided with the drawer doors 81, 83, and 85, respectively are arranged from top to bottom in the refrigerator main body 74. This arrangement allows the refrigerator which can be installed in a small space to be used easily and to have multiple section control. In particular, the vegetable chamber 78 in the middle has an increased actual storing capacity as an indirect cooling chamber. Since the vegetable chamber 78 is provided with the drawer door 81, the user is able to handle the contents while taking an extensive view of the whole from above in a standing posture without stooping. This allows the refrigerator to sufficiently store vegetables and fruits especially much consumed due to a recent health boom.

Further, the first cooler 88 is arranged side by side with the compressor 44. This arrangement allows the refrigerator to be lower. As a result, the first cooler 88, the first fan 89, and the damper unit 90 which are disposed there above may be installed at the back of the freezing chamber 79 and do not intrude in the rear of the vegetable chamber 78. Accordingly, the length of the storage container 82 of the vegetable chamber can be elongated up to near the back insulating material, and this arrangement increases the storing capacity.

(Exemplary Embodiment 4)

Figure 8:
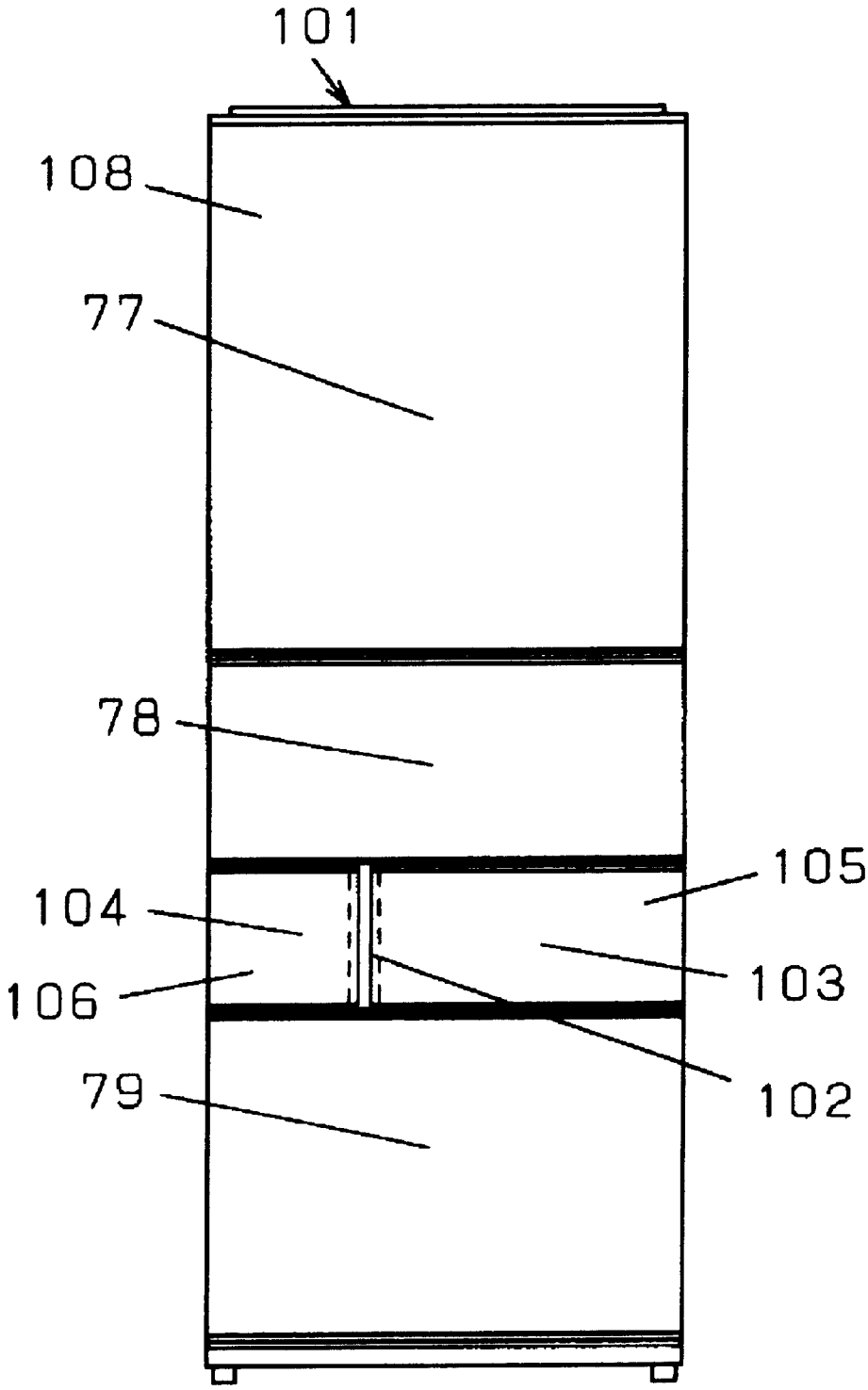
FIG. 8 is an outside front view of a refrigerator according to exemplary embodiment 4 of the invention.
Figure 9:
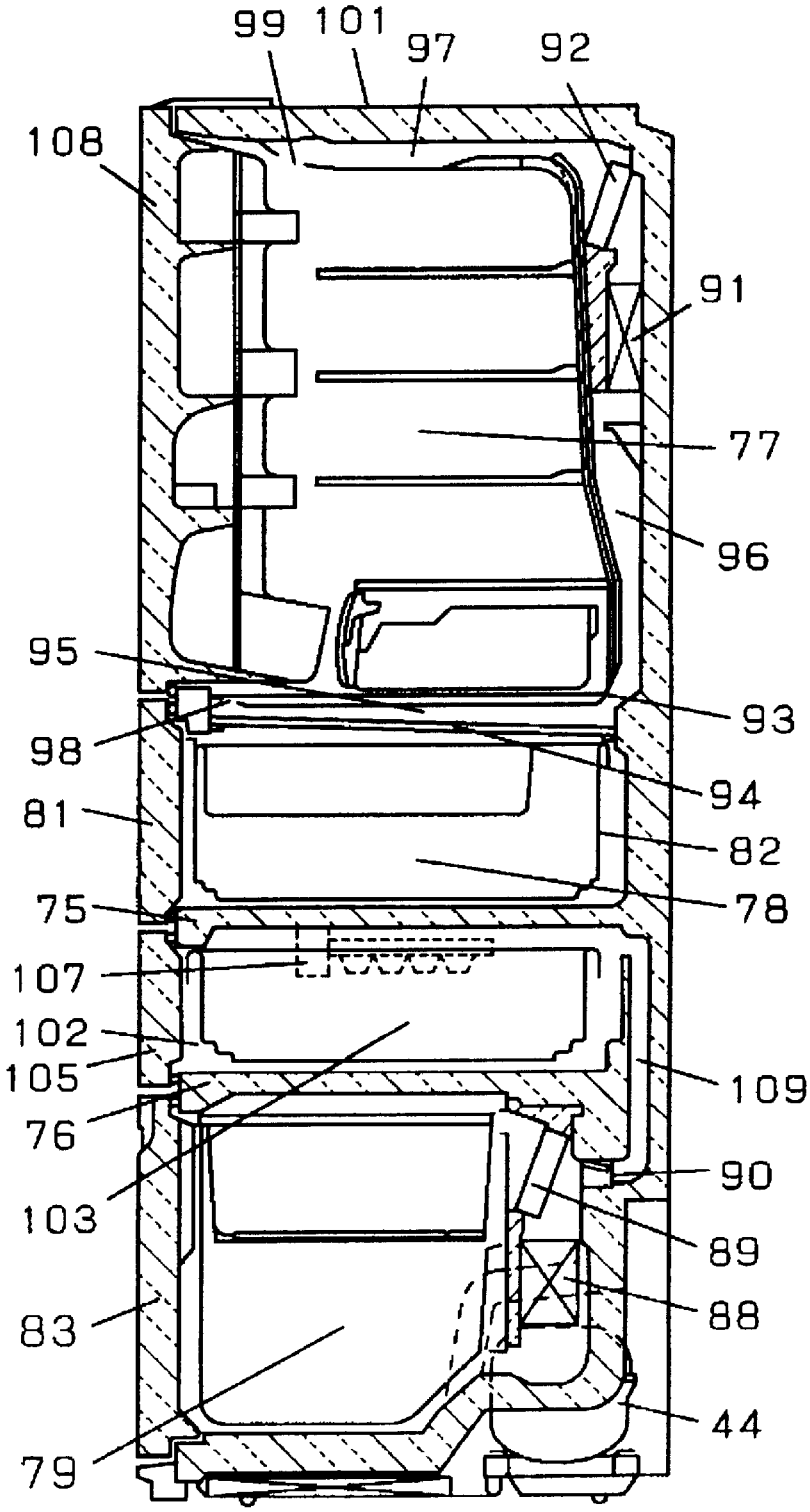
FIG. 9 is a sectional view of the refrigerator according to embodiment 4.

FIG. 8 is an outside front view of a refrigerator according to exemplary embodiment 4 of the present invention. FIG. 9 is a sectional view of the refrigerator. Insulating partition wall 75 partitions refrigerator main body 101 into upper and lower sections to form refrigerating chamber 77 at the top and vegetable chamber 78 thereunder. Insulating partition wall 76 forms freezing chamber 79 at the bottom. Insulating partition wall 102 is disposed lengthwise between the insulating partition walls 75 and 76, thus forming multi-purpose chamber 103 and ice maker chamber 104 at the right and left.

Drawer door 105 is fitted to the opening of the multipurpose chamber 103. Drawer door 106 is fitted to the opening of the ice maker chamber 104 Ice maker 107 is disposed at the ceiling of the ice maker chamber 104. Hinged door 108 is fitted to the opening of the refrigerating chamber 79.

First fan 89 delivers the air cooled by first cooler 88 into the multipurpose chamber 103 through draft passage 109 and damper unit 90. The fan 89 directly guides the air cooled by the cooler 88 to the ice maker chamber 104 through a draft passage (not shown).

The freezing chamber 79 and the ice maker chamber 104 functions as a direct cooling chamber with the cooler 88 and fan 89. The refrigerating chamber 77 functions as a direct cooling chamber with the cooler 91 and fan 92. The multipurpose chamber 103 functions as a direct cooling chamber with the cooler 88, fan 89 and damper unit 90. The direct cooling chamber directly introduces the cool air into the interior. The cool air is not directly introduced into the vegetable chamber 78, which functions as an indirect cooling chamber via the cooling plate 94.

An operation of the above refrigerator will be described.

The air cooled by the first cooler 88 is directly introduced by the first fan 89 into the freezing chamber 79 and the ice maker chamber 104. The contents of the freezing chamber 79 are directly cooled by forced convection and stored at freezing temperatures. In the ice maker chamber 104, the cool air serves to make ice by the ice maker 107. A part of the cool air is adjusted by the damper unit 90 to an appropriate amount and is directly introduced into the multipurpose chamber 103 through the draft passage 109 in order to directly cool the contents by forced convection. The contents are stored at desired temperatures ranging from a refrigerating temperature to a freezing temperature in accordance with the adjustment made by the user.

The air cooled by the second cooler 91 is directly discharged by the second fan 92 into the refrigerating chamber 77 from the discharge port 99 through the discharge air passage 97. A part of the cooled air for cooling the contents of the refrigerating chamber 77 directly by forced convection is guided into the draft passage 95 from the intake port 98 at the bottom, and returns to the second cooler 91 through the intake air passage 96 after cooling the cooling plate 94. That is, the refrigerating chamber 77, freezing chamber 79, multi-purpose chamber 103, and ice maker chamber 104 function as direct cooling chambers for cooling the contents by forced convection of the cooled air directly introduced into the interior or for making ice. Accordingly, the contents stored in these chambers are rapidly cooled since being placed under a cooling environment having a relatively large heat transfer coefficient. Thus, these cooling chambers are suitable for cool-storing general foods, such as daily dishes, processed foods, frozen foods, and drinks, which are preferably cooled down to specified storage temperatures in a short time when they are stored for the first time or when the temperature is raised due to opening and closing of the door, or for making a large quantity of ice in a short time.

The cooling plate 94 cooled by the forced convection of the cool air flowing in the draft passage 95 is made of material having a large thermal conductivity, and is quickly and nearly uniformly cooled over the entire surface thereof and is lowered in temperature. Accordingly, the cooling plate 94 functions as an indirect cooling plate for cooling the vegetable chamber 78 and disposed at the top thereof. That is, the cooling plate 94 indirectly cools the contents of the storage container 82 by radiant cooling with a temperature difference and downward cooling caused due to natural convection, and allows the vegetable chamber 78 to function as an indirect cooling chamber.

Accordingly, in the vegetable chamber 78, the contents are placed under a cooling environment having a relatively small heat transfer coefficient, thus suppressing their drying. Therefore, the vegetable chamber is suitable for the cooling storage of perishable foods, such as vegetables and fruits, of which storage quality is closely related with transpiration of water in particular.

As described above, the refrigerator is partitioned into three or more sections of storage chambers, direct cooling chambers kept at freezing and refrigerating temperatures, direct cooling chambers having a function of being able to select proper temperatures, direct cooling chambers having an independent function of ice making, and indirect cooling chambers kept at refrigerating temperatures. This arrangement suppresses the reduction of food quality under storage control in accordance with the suitability for storage of stored foods and to assure excellent storage performance. Further, the refrigerator is used conveniently because of the ice maker chamber 104 independently disposed.

The improvement of the storing capacity of the vegetable chamber 78 is similar to that in embodiment 3, and thus, the description is omitted.

(Exemplary Embodiment 5)

Figure 10:
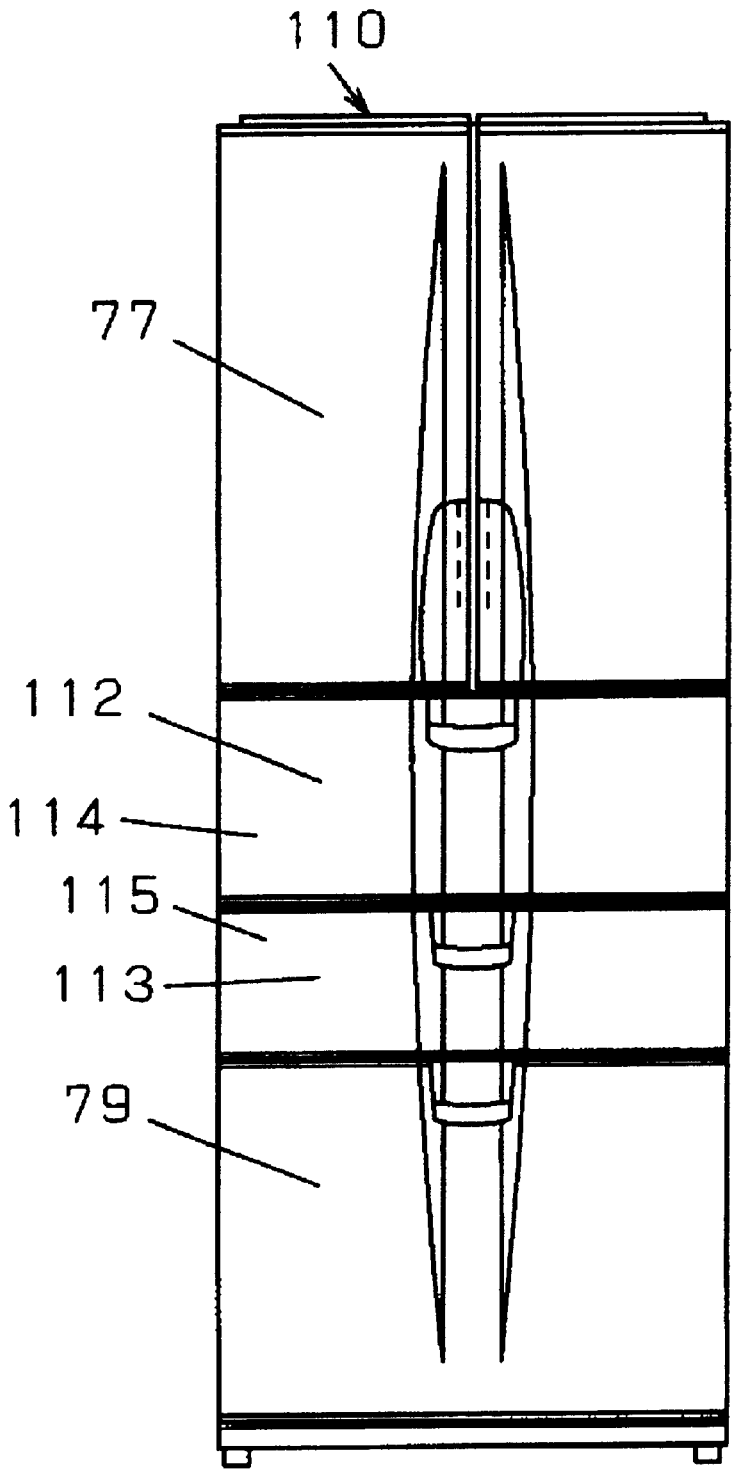
FIG. 10 is an outside front view of a refrigerator according to exemplary embodiment 5 of the invention.
Figure 11:
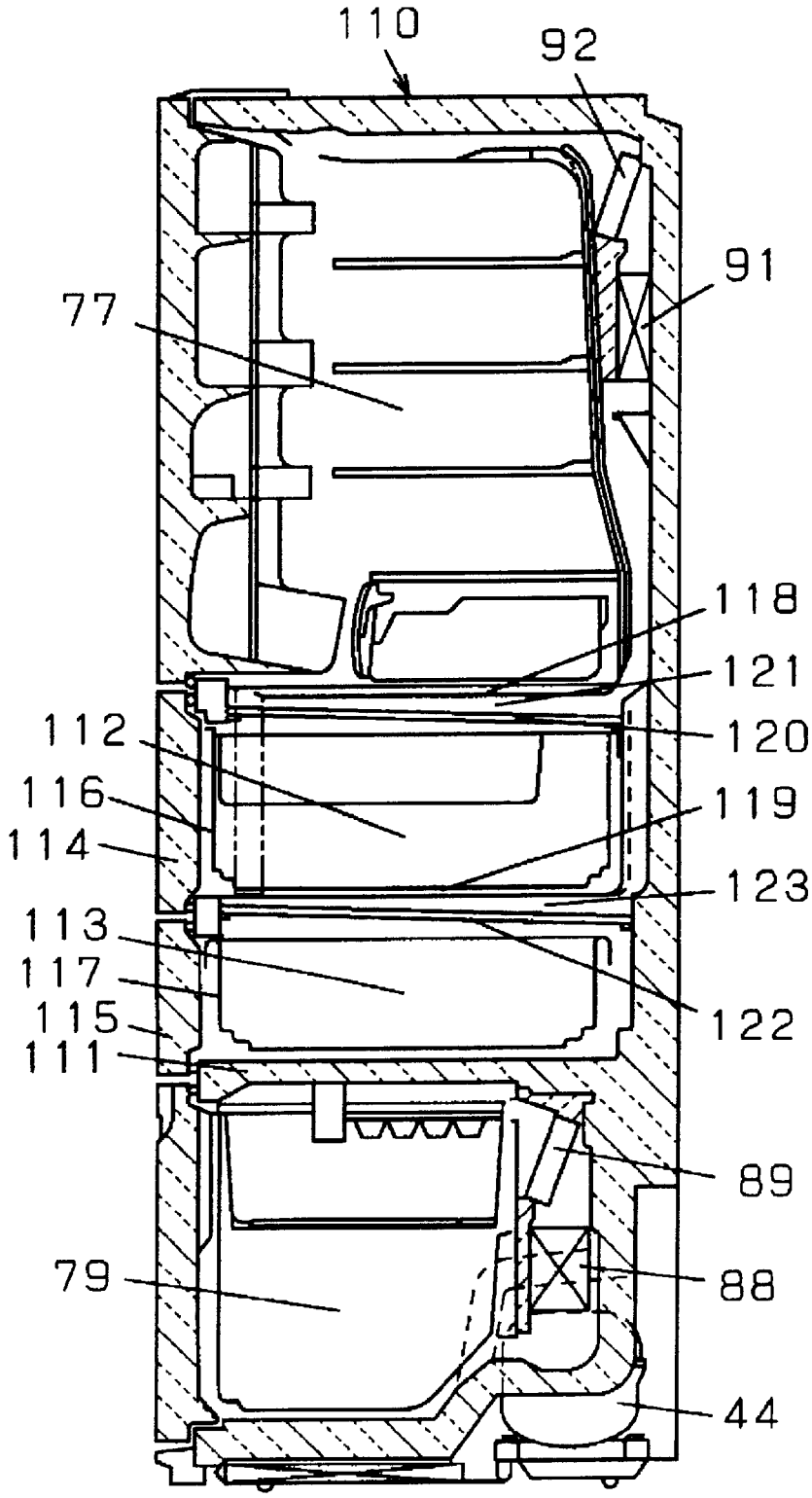
FIG. 11 is a sectional view of the refrigerator according to embodiment 5.
Figure 12:
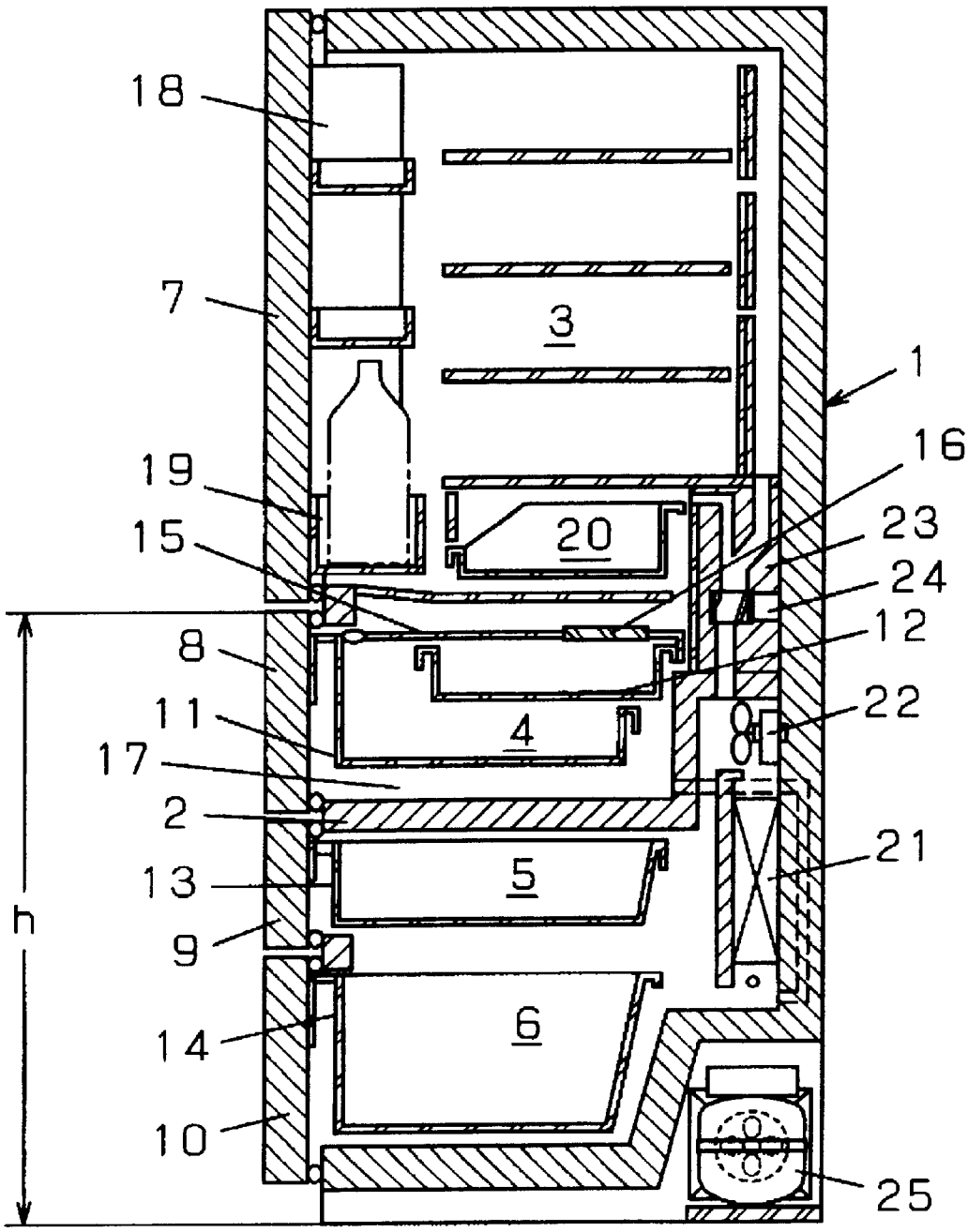
FIG. 12 is a sectional view of a conventional refrigerator.

FIG. 10 is an outside front view of a refrigerator in exempalry embodiment 5 of the present invention. FIG. 11 is a sectional view of the refrigerator. Insulating partition wall 111 partitions refrigerator main body 110 into upper and lower sections, forming refrigerating chamber 77 at the top and vegetable chamber 112 thereunder, also perishable food chamber 113 thereunder, and freezing chamber 79 at the bottom. Drawer doors 114 and 115 are fitted to the front opening portions of the vegetable chamber 112 and the perishable food chamber 113, respectively. Doors 114 and 115 are drawn out along with storage containers 116 and 117, respectively.

Partition plate 118 is disposed between the refrigerating chamber 77 and the vegetable chamber 112. Partition plate 119 is disposed between the vegetable chamber 112 and the perishable food chamber 113. Cooling plate 120 having a high thermal conductivity closes the top opening of the vegetable chamber 112 at a specified interval under the partition plate 118. Draft passage 121 is provided between the partition plate 118 and the cooling plate 120. Cooling plate 122 having a large thermal conductivity for closing the top opening of the perishable food chamber 113 is disposed at a specified interval under the partition plate 119. Draft passage 123 is provided between the partition plate 119 and the cooling plate 122.

The air cooled by the second cooler 91 disposed in the refrigerating chamber 77 is directly delivered by the second fan 92 into the draft passages 121 and 123 and cooling the cooling plates 120 and 122. Accordingly, the cool air is not directly introduced into the vegetable chamber 112 or perishable food chamber 113 which are indirectly cooled by radiant cooling from top and downward cooling by natural convection.

Thus, in addition to the vegetable chamber 112, since the perishable food chamber 113 also functions as an indirect cooling chamber, the refrigerator can store perishable foods for which drying is undesirable from drying in different sections for vegetables, fruits, and other fish, meat and the like. In particular, since fish and meat are prevented from drying and quality deterioration caused due to oxidation, the a refrigerator may assure high storage quality for general perishable foods.

Under a recent trend of increase in using frequency of a refrigerator due to the increasing consumption of perishable foods, according to the present invention, the refrigerator has indirect cooling chambers with drawer doors 116 and 117 in the middle of the refrigerator main body 110, which is used more easily and assures a sufficient storing capacity.

INDUSTRIAL APPLICABILITY

The present invention relates to a refrigerator having three or more sections of storage chambers vertically arranged.

The refrigerator of the present invention includes three or more storage chambers vertically arranged. At least one of the chambers is an indirect cooling chamber cooled without cool air into introduced in its interior. The other chambers are direct cooling chambers cooled by the cool air introducing into their interiors. The installation space for the refrigerator may be suppressed. Foods for which drying or oxidation is undesirable can be stored in the indirect cooling chamber of the refrigerator, and other foods that should be quickly cooled can be stored in the direct cooling chamber. This provides the refrigerator with multiple section control that assures excellent storage quality.

What is claimed is:

1. A refrigerator comprising:

a plurality of direct cooling chambers cooled by cool air introduced therein; and an indirect cooling chamber having an outer envelope thereof closing said indirect cooling chamber, said outer envelope including a cooling plate receiving cool air from at least one of said plurality of direct cooling chambers, said indirect cooling chamber being cooled by said cooling plate, wherein said indirect cooling chamber and said direct cooling chamber are vertically arranged.

2. The refrigerator of claim 1, further comprising:

a cooler of freezing cycle for generating the cool air; and a fan for delivering the cool air.

3. The refrigerator of claim 1, wherein said cooling plate has a large thermal conductivity.

4. The refrigerator of claim 2, wherein said cooler is disposed in one of said direct cooling chambers.

5. The refrigerator of claim 1, wherein said indirect cooling chamber is disposed between said direct cooling chambers.

6. The refrigerator of claim 1, wherein said indirect cooling chamber is a vegetable chamber.

7. A refrigerator comprising:

first, second, and third storage chambers vertically arranged;

a first cooler for cooling said first storage chamber;

a second cooler for cooling said second and third storage chambers; and first and second fans for delivering air cooled by said first and second coolers, respectively, wherein said first and second storage chambers are direct cooling chambers cooled by forced convection created by said first and second fans, respectively, and wherein said third storage chamber is an indirect cooling chamber having an outer envelope thereof closing said indirect cooling chamber, said outer envelope including a cooling plate cooled by cooled air from at least one of said first and second storage chambers, and said third storage chamber being cooled by said cooling plate.

8. The refrigerator of claim 7, wherein said first and second coolers are disposed in said first and second storage chambers, respectively.

9. The refrigerator of claim 7, wherein said cooling plate has a large thermal conductivity.

10. The refrigerator of claim 7, wherein said third storage chamber is disposed in a nearly middle of said refrigerator.

11. The refrigerator of claim 7, wherein said third storage chamber is disposed between said first and second storage chambers.

12. The refrigerator of claim 7, wherein said third storage chamber is a vegetable chamber.

13. The refrigerator of claim 12, wherein said first storage chamber is a freezing chamber, and wherein said second storage chamber is a refrigerating chamber.

14. The refrigerator of claim 13, wherein said refrigerating chamber is arranged above said freezing chamber.

15. The refrigerator of claim 13, further comprising:

a drawer door provided for said vegetable chamber.

16. The refrigerator of claim 15, further comprising:

a drawer door provided for said freezing chamber; and a hinged door provided for said refrigerating chamber.

17. The refrigerator of claim 16, wherein said hinged door of said refrigerating chamber includes a double door.

18. The refrigerator claim 15, wherein a height (H) from a floor of installation to an upper end of said door of said vegetable chamber satisfies 600 mm$\leqq$H<850 mm.

19. The refrigerator of claim 13, further comprising:

a compressor for freezing cycle, wherein said compressor and said first cooler are arranged side by side at a back of said freezing chamber.

20. A refrigerator comprising:

a plurality of direct cooling chambers cooled by cool air introduced therein; and an indirect cooling chamber having an outer envelope thereof closing said indirect cooling chamber, said outer envelope including a cooling plate receiving said cool air, said cooling plate forming a vertically-upper portion of said outer envelope, said indirect cooling chamber being cooled by said cooling plate, wherein said indirect cooling chamber and said direct cooling chamber are vertically arranged.

21. The refrigerator of claim 20, wherein said cooling plate has a large thermal conductivity.

22. A refrigerator comprising:

a first, second, and third storage chambers vertically arranged;

a first cooler for cooling said first storage chamber;

a second cooler for cooling said second and third storage chambers; and first and second fans for delivering air cooled by said first and second coolers, respectively;

wherein said first and second storage chambers are direct cooling chambers cooled by forced convection created by said first and second fans, respectively, and wherein said third storage chamber is an indirect cooling chamber having an outer envelope thereof closing said indirect cooling chamber, said outer envelope including a cooling plate cooled by forced convection created by one of said first and second fans, said cooling plate forming a vertically-upper portion of said outer envelope, said third storage chamber being cooled by said cooling plate.

23. The refrigerator of claim 22, wherein said cooling plate has a large thermal conductivity.

* * * * *